US005373215A

United States Patent [19]

Steinkraus, Jr.

[11] Patent Number: 5,373,215

[45] Date of Patent: Dec. 13, 1994

[54] IONIZATION TUBE SIMMER CURRENT CIRCUIT

[75] Inventor: Robert F. Steinkraus, Jr., Livermore, Calif.

[73] Assignee: The United States of America as represented by the United States Department of Energy, Washington, D.C.

[21] Appl. No.: 87,221

[22] Filed: Jul. 7, 1993

[51] Int. Cl.[5] ..... H05B 37/00

[52] U.S. Cl. ..... 315/200 R; 315/205; 315/243; 315/287; 315/307; 315/105; 315/106

[58] Field of Search ..... 315/200 R, 105, 205, 315/106, 307, 243, 284

[56] References Cited

U.S. PATENT DOCUMENTS

| | | | |
|---|---|---|---|
| 3,863,102 | 1/1975 | Herzog | 315/105 |
| 4,134,044 | 1/1979 | Holmes | 315/209 R |
| 4,340,843 | 7/1982 | Anderson | 315/205 |
| 4,603,281 | 7/1986 | Nilssen | 315/106 |
| 4,904,907 | 2/1990 | Allison et al. | 315/307 |
| 4,945,291 | 7/1990 | Masaki | 315/307 |
| 5,008,599 | 4/1991 | Counts | 315/243 |
| 5,140,228 | 8/1992 | Biegel | 315/284 |

*Primary Examiner*—Robert J. Pascal
*Assistant Examiner*—Reginald A. Ratliff
*Attorney, Agent, or Firm*—Henry P. Sartoiro; Roger S. Gaither; William R. Moser

[57] ABSTRACT

A highly efficient flash lamp simmer current circuit utilizes a fifty percent duty cycle square wave pulse generator to pass a current over a current limiting inductor to a full wave rectifier. The DC output of the rectifier is then passed over a voltage smoothing capacitor through a reverse current blocking diode to a flash lamp tube to sustain ionization in the tube between discharges via a small simmer current. An alternate embodiment of the circuit combines the pulse generator and inductor in the form of an FET off line square wave generator with an impedance limited step up output transformer which is then applied to the full wave rectifier as before to yield a similar simmer current.

10 Claims, 3 Drawing Sheets

IONIZATION TUBE SIMMER CURRENT CIRCUIT

The United States Government has rights in this invention pursuant to Contract No. W-7405-ENG-48 between the United States Department of Energy and the University of California for the operation of Lawrence Livermore National Laboratory.

BACKGROUND OF THE INVENTION

1. Field of the Invention

The invention lies in the field of electronics and in particular relates to electrical circuits for producing a simmer current to high output flash lamps such as those made of Xenon and other ionization tubes where a certain population or degree of ionization is desired to be maintained. More specifically, the invention relates to electrical circuits for supplying a low and steady current to maintain ionization in a flash lamp load that customarily has a negative resistance at that level of current.

2. Description of Related Art

Pulsed lasers are commonly pumped to a population inversion with a high intensity light source. To provide this light, most pulsed lasers use flash lamps such as the standard Xenon flash lamp. In operation, the gas in the flash lamp tube must first be ionized with a high voltage before a current can be initiated. For Xenon, a voltage of about 40,000 volts is required to initiate a current. After current initiation, the voltage drop across the tube decreases rapidly to a few hundred volts. Thereafter, with a small, steady current through the flash lamp tube of approximately 100 milliamps, ionization will be maintained in a Xenon tube. This small, steady current is termed a "simmer current." When a high intensity flash pulse is desired, a high power electrical pulse is applied to the flash lamp, which in turn reliably produces the high intensity flash which then pumps the laser gain material.

Electrical characteristics of a flash lamp are illustrated in the FIG. 1 graph of voltage vs. current where three independent curves are drawn. In FIG. 1, the straight line curve labeled PS indicates the load line of a Power Supply for a simmer current to a flash lamp. PS indicates that at maximum voltage the power supply delivers minimum current, and at minimum voltage the supply would yield maximum current. Straight line curve RL is indicative of a typical Resistor Load that one might expect in any circuit. As the voltage increases so to does the current flow; at maximum voltage, we get maximum current and at minimum voltage, we get minimum current. On the other hand the unconventional or unusual Flash Lamp voltage vs. current load line is indicated in curve FL. It will be observed that a large voltage must be applied to initiate the current. Following current initiation, voltage decreases rapidly while current increases, resulting in a negative slope. For maximum operational efficiency, it is suggested to simmer a flash lamp at a voltage and current at an Optimum Point indicated as OP in FIG. 1.

Maintaining this operational point, however, creates a stability problem due to the negative resistance of the flash lamp. To address the stability problem, prior art teaches that a large resistor R need be coupled in series with a voltage source VS as illustrated in FIG. 2 to limit essentially infinite current flow at low voltage past the OP. The result is a circuit that works, but the power efficiency of such a prior art circuit is only 5 to 10%. A large amount of waste heat is produced in the resistor R, and a relatively large and bulky package is required for the physically large high power components.

The invention disclosed herein resolves the foregoing long standing limitations and prior art problems with a simmer current circuit in a unique and novel manner. The invention discloses an electrical circuit that provides a steady current to a negative resistance load such as a flash lamp that pumps a pulsed laser. Such a steady current can simmer the flash lamp so that it remains ionized throughout a series of pulses, while at the same time performing at a substantially higher efficiency (70 to 80%) in converting electrical energy to current through the flash lamp. By such means, the invention offers less heat generation, less loss of energy, less expense, longer life, as well as a much smaller, lighter and compact package of components.

SUMMARY OF THE INVENTION

It is therefor a primary object of the invention to accommodate a flash lamp with an improved simmer current circuit to efficiently sustain ionization in a flash lamp between discharges.

A particular object is to substantially improve efficiency of a flash lamp utilization of a power supply for a simmer current circuit by increasing the power from the power supply from around 5% in the prior art to 70% in the invention disclosed herein.

Yet another object is to substantially attenuate heat dissipation and concomitant loss and waste of energy of a simmer current circuit power supply encountered in the prior art.

Still another object is to decrease operating cost of a flash lamp simmer current circuit.

With the benefit of less heat dissipation and less cooling requirements, a further object of the invention is the ability to use a smaller, lighter, and less expensive power supply for a simmer current circuit.

A further object of the invention is to be able to manually vary a simmer current and power supplied to a flash lamp.

Another object is to utilize a simmer current circuit that is more reliable and longer lived than exists in the prior art.

All the foregoing objects and more advantageous features and benefits in addition to others will become more readily apparent in view of the following drawing as explained in the specification and as limited only by the appended claims.

Although the invention may have numerous and varied applications, the main intent and purpose in conceiving and reducing the invention to practice was to provide for an electronic circuit that could more efficiently and reliably supply a relatively low and steady simmer current to a relatively high output flash lamp for the purpose of sustaining a degree of ionization of the gas in the flash lamp.

With that in mind, the invention conceives a flash lamp simmer current circuit having a pulse generator delivering a fifty percent duty cycle square wave through a current limiting inductor to a full wave rectifier in the form of a diode bridge consisting of a pair of parallel leads with each lead having a pair of opposed diodes in each lead. A direct current output of the rectifier is then passed over a voltage smoothing capacitor, through a current blocking isolation diode to the flash lamp tube to maintain a small current flow in the tube and thereby sustain ionization in the flash tube. A second avalanche rated isolation diode is also positioned between a conventional high voltage circuit and the flash lamp tube to separate the high voltage flash lamp discharge circuit from the flash lamp simmer current circuit.

DETAILED DESCRIPTION OF THE INVENTION

The invention was conceived to provide a compact, efficient, low cost, long life circuit for simmering a flash lamp. In large part, the invention conceives avoiding the use of large resistors in the current path, and instead suggests the use of an inductor to limit current. The inductor limits current from a source of alternating current. The limited current is then rectified to yield the required direct current necessary for a simmer current circuit for a flash lamp.

Figure 1:
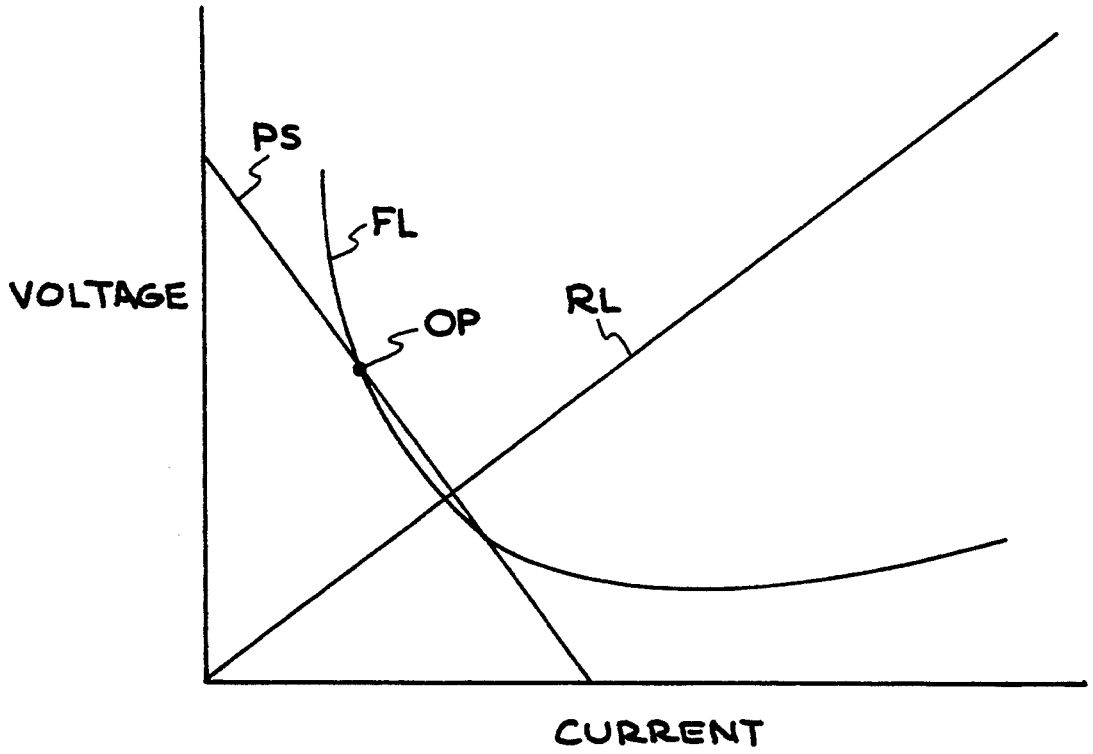
FIG. 1 is a graph illustrating the electrical characteristics of a flash lamp.
Figure 2:
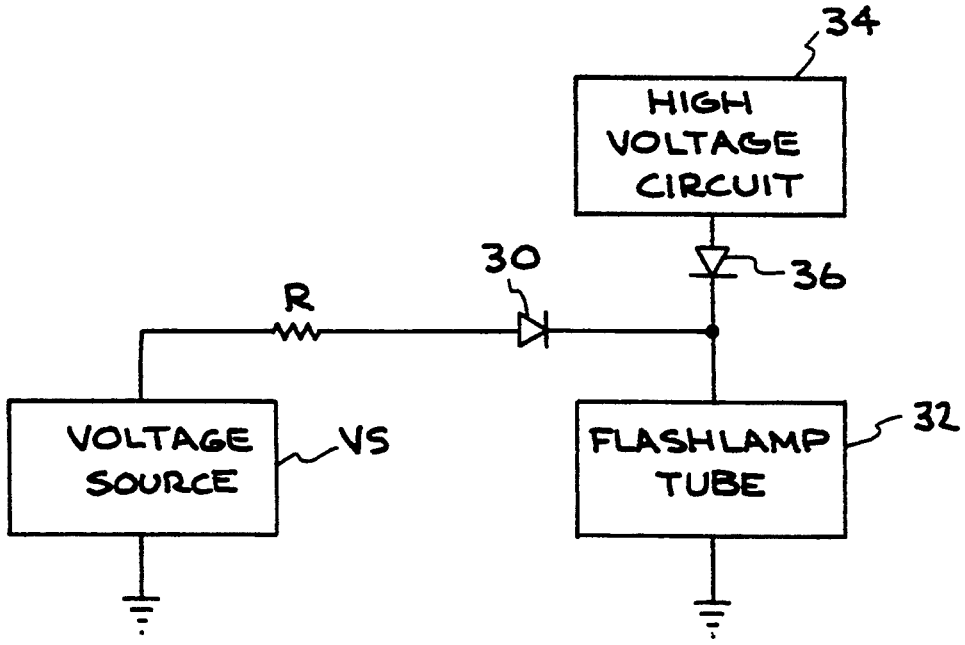
FIG. 2 (PRIOR ART)
FIG. 2 is a schematic of a prior-art simmer circuit.
Figure 3A:
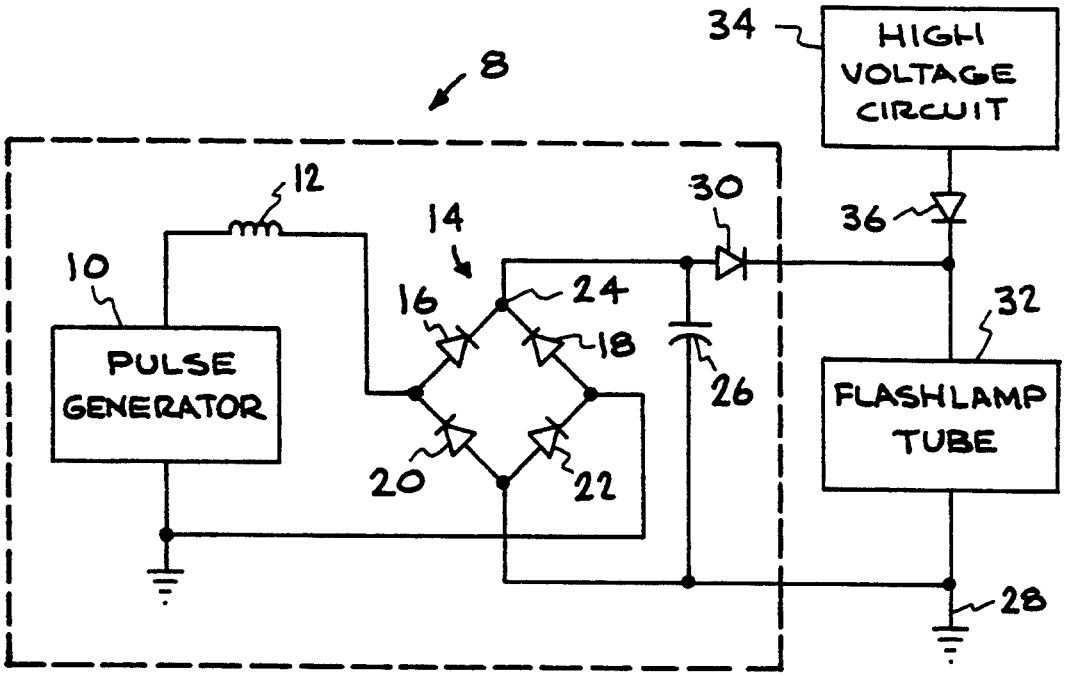
FIG. 3*a* is a schematic of the invention simmer circuit.

The basic elements of the invention are enclosed within dashed box 8 FIG. 3*a*. In FIG. 3*a*, a high frequency pulse generator 10 such as a 100 kiloHertz (kHz) square wave generator with a 50% duty cycle is configured to provide a 4000 volt peak square wave series of pulses through an inductor 12. Inductor 12 is approximately 4.2 milliHenries (mH) and operates as a current limiting element when coupled in series with an alternating wave form. For purposes of the invention, high frequency pulse generator 10 may provide a lower or higher frequency to the circuit, although to do so would require a change in the value, of inductor 12. If a lower frequency were to be used, inductor 12 would have a larger value to provide an equivalent current limiting capability. It should be understood that pulse generator 10 may equally as well provide a sine wave or other alternating current (AC) wave form as opposed to a square wave output indicated in the preferred embodiment.

Inductor 12 is coupled to a full wave rectifier 14, consisting of a diode bridge in which a first pair of opposed diodes 16 and 18 are connected in parallel with a second pair of opposed diodes 20 and 22. Diodes 16 to 22 are 6 kilovolt (kV) and 3 Amp rated with a 35 nanosecond (ns) reverse recovery time ($T_{rr}$). A direct current (DC) output 24 of rectifier 14 is passed over a capacitor 26 to ground 28. Capacitor 26, a 0.1 microfarad (uf) capacitor, is essentially coupled across rectifier 14 and is included to smooth DC voltage fluctuations beyond the smoothing accomplished in rectifier 14. A simmer current is then provided to a flash lamp tube 32 through a current blocking, isolation diode 30. Isolation diode 30 is a diode with a high reverse breakdown voltage and in the preferred embodiment is rated at 50 kV and 3 Amp with a 100 ns $T_{rr}$. Isolation diode 30 isolates rectifier 14 from high voltage pulses from a high voltage circuit 34 which conventionally and periodically delivers a high voltage pulse through a second isolation diode 36 to cause a discharge of flash lamp tube 32. Second isolation diode 36 is an avalanche rated diode with characteristics of 10 kV and 3 Amp and a $T_{rr}$ of 300 ns. A typical high voltage circuit 34 applied to a typical flashlamp tube 32 which is operating as a laser pump is in the range of 7 kV and $10^6$ Watt with a 60 kWatt (kW) average output. Blocking diode 30 is necessary to protect the simmer circuit of FIG. 3*a* from high voltage circuit 34. Likewise, diode 36 prevents electrical pulses from simmer circuit 8 and from flash lamp tube 32 from going into high voltage circuit 34.

Figure 3B:
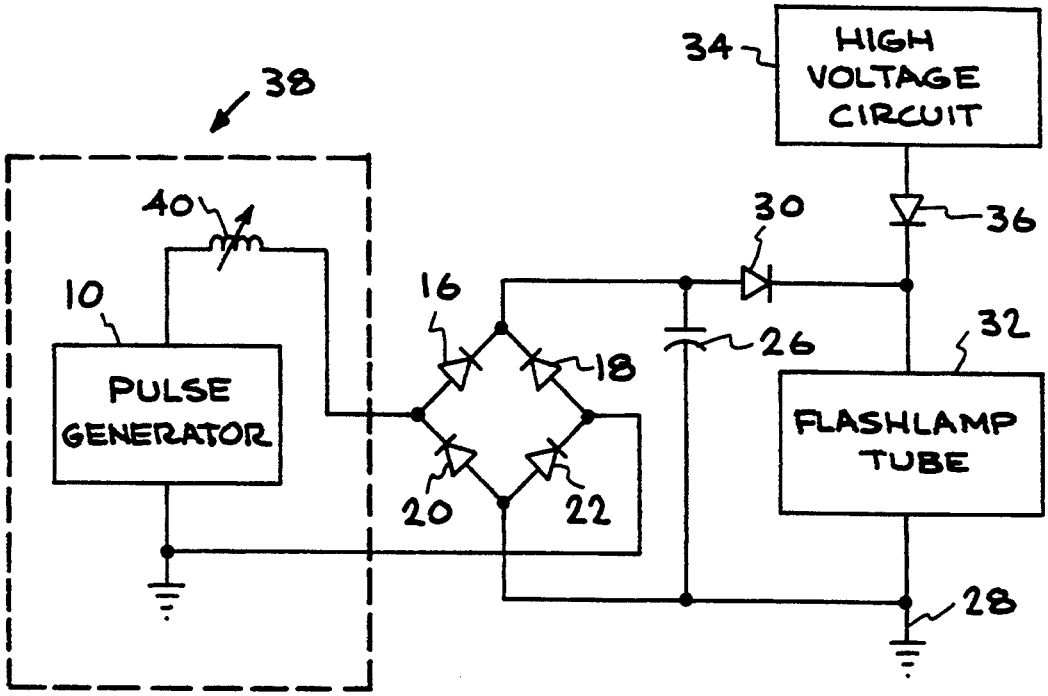
FIG. 3*b* is an alternate embodiment of the invention simmer circuit.

Referring now to FIG. 3*b*, an alternate embodiment of the invention is illustrated. In FIG. 3*b*, pulse generator 10 and inductor 12 of FIG. 3*a* have been combined in a single pulse generator element illustrated as dashed box 38 to perform a similar function as in FIG. 3*a*, but with the added advantage that a variable inductor 40 allows desired variation and tuning of the simmer circuit. Pulse generator element 38 is actually a 45% duty cycle FET (field effect transistor) off line square wave generator with an impedance limited step up output transformer. More commonly referred to as a transducer or magnetic amplifier, pulse generator element 38 is commercially available from Ferroxcube. Several ranges of transductors are commercially available. Basically, the transductor consists of a magnetic core formed from two rings of Ferrite. A control and bias winding is applied to the two rings in parallel while a signal winding is in two series halves, each embracing one ring and wound in opposite directions so that coupling with the control winding is avoided. In such a construction the inductance of the control winding varies with control current in proportion to the inductance of the signal winding.

Figure 4:
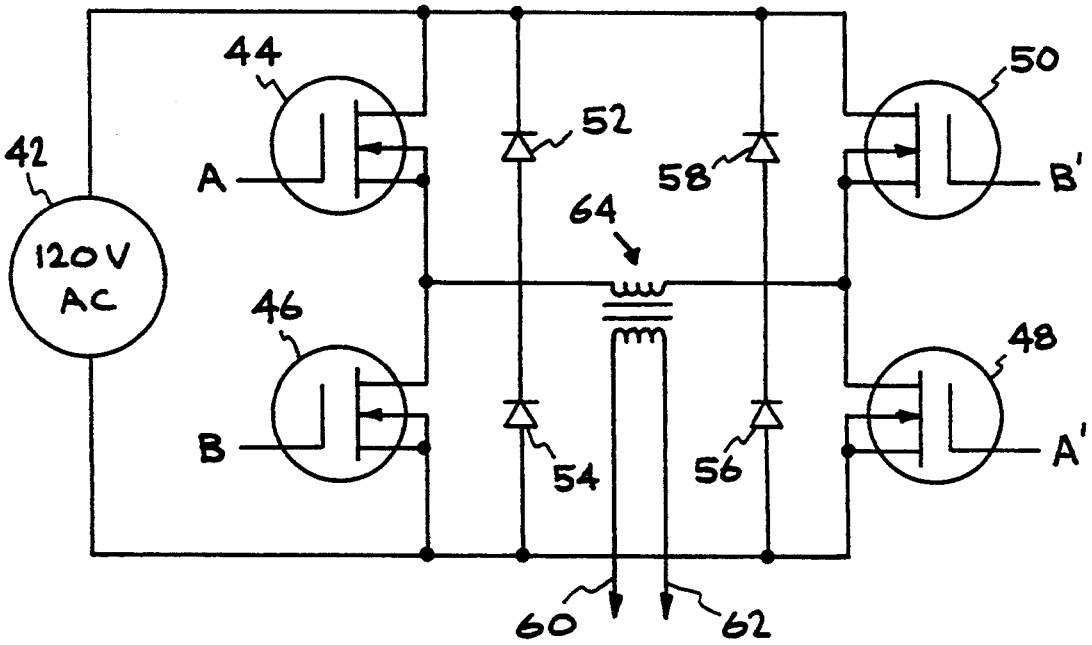
FIG. 4 is a schematic of the pulse generator of FIGS. 3*a* and 3*b*.
Figure 5:
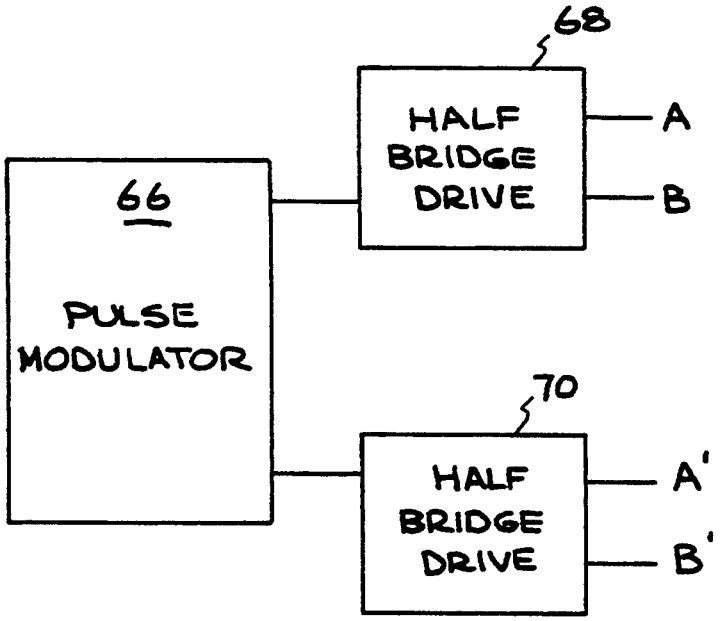
FIG. 5 is a block diagram of the pulse modulator for the pulse generator of FIG. 4.

FIG. 4 illustrates a schematic of a square wave pulse generator 10 of FIG. 3*a* for producing the necessary high frequency pulses for simmer circuit 8. In FIG. 4, a 120 Volt AC source is applied to two pair of FET's coupled in parallel 44, 46, and 48, 50 defined as. . . . Each pair of FET's 44, 46, and 48, 50 with control inputs A, B, and A', B' is in turn coupled in parallel with a pair of diodes 52, 54, and 56, 58, respectfully. Diodes 52 through 56 are identical to diodes 16 through 20 above. Outputs 60 and 62 of the square wave generator are taken from a transformer 64 coupled across and at midpoint of each pair of FET's 44, 46 and 48, 50. It should be noted that the real output 60,62 of transformer 64 has an inductance. The value of this inductance produces a current limiting effect similar to that of inductor 12 of FIG. 3*a* with which it is in series and must of course be considered in determining what current limiting effects are desired. Variation and control of inductance and current limiting effects are achieved via a pulse modulator circuit. FIG. 5 illustrates a block diagram of a control circuit for the control inputs A, B and A', B' of the pulse generator of FIG. 4. In FIG. 5, a pulse modulator 66 is applied to a pair of half bridge drives 68 and 70 which in turn provide pulse generator outputs A, B and A', B', respectfully, to be applied to FET's 44, 46 and 56, 58, respectively.

Although the foregoing describes in some detail the elements of a preferred embodiment of the invention and how it may be made and used, it will be understood that the above described elements and components thereof are delineated for purposes of illustration and explanation of a best mode embodiment of the invention only and by no means do they limit of define the breadth of the invention concept. The invention is defined and the scope thereof is limited only with respect to the following appended claims as interpreted by the attached drawing and specification.

I claim:

1. A simmer current circuit for maintaining ionization in a load, comprising:

a pulse generator;

a full wave rectifier having a pair of AC inputs and a DC output;

an inductor coupled between said pulse generator and an AC input of said full wave rectifier, wherein said pulse generator and said inductor are combined in an FET off line square wave generator with an impedance limited step up output transformer;

a capacitor coupled across said DC output and ground of said full wave rectifier; and a reverse current blocking diode coupled between said DC output and said load.

2. A simmer current circuit according to claim 1, wherein said load is a flash lamp.

3. A simmer current circuit according to claim 1, wherein said pulse generator is an alternating current (AC) wave generator.

4. A simmer current circuit according to claim 1, wherein said full wave rectifier consists of two pair of opposed diodes, whereby each said pair is coupled in parallel between said pulse generator output and ground.

5. A simmer current circuit, comprising:

signal generator means, wherein said signal generator means consists of a square wave generator;

variable current limiting means comprising an inductor coupled to said signal generator means, wherein said generator and said inductor are combined in an FET off line square wave generator with an impedance limited step up output transformer;

current rectification means coupled to said current limiting means;

voltage smoothing means coupled to said rectification means; and current blocking means coupled to output of said rectification means.

6. A simmer current circuit according to claim 5, wherein said rectification means consists of two pair of opposed diodes coupled in parallel.

7. A simmer current circuit according to claim 6, wherein said voltage smoothing means is a capacitor coupling a DC output of said rectification means to ground.

8. A simmer current circuit according to claim 7, wherein said current blocking means is a diode.

9. A method for maintaining a simmer current sufficient to sustain a population and degree of ionization in a flash lamp tube, comprising the steps of:

providing an AC input signal, wherein .said step for providing an AC input consists of providing a square wave;

variably limiting current of said AC input signal, wherein said current is variably limited by means of an inductor, wherein said square wave and said inductor are combined in an FET off line square wave generator with an impedance limited step up output transformer;

rectifying said AC input signal to yield a DC input to said flash lamp tube, wherein said rectification step is accomplished by means of an opposed diode bridge;

smoothing a voltage level of said DC input; and blocking reverse current of said DC input, wherein said reverse current is blocked by means of a diode.

10. A method for maintaining a simmer current according to claim 9, wherein said voltage smoothing step is achieved by means of a capacitor.

* * * * *